United States Patent [19]

Krsna

[11] Patent Number: 4,864,547

[45] Date of Patent: Sep. 5, 1989

[54] REGULATED ULTRASONIC GENERATOR

[75] Inventor: Steve Krsna, Wrightstown, N.J.

[73] Assignee: Crestek, Inc., Trenton, N.J.

[21] Appl. No.: 865,255

[22] Filed: May 20, 1986

[51] Int. Cl.[4] ..... G10K 11/00

[52] U.S. Cl. ..... 367/137; 310/317

[58] Field of Search ..... 367/137, 138; 310/317, 310/316, 118; 73/642, 596, 602; 363/55, 56, 58, 93, 132; 318/118

[56] References Cited

U.S. PATENT DOCUMENTS

| | | | |
|---|---|---|---|
| 2,778,002 | 1/1957 | Howry | 367/137 |
| 3,460,025 | 8/1969 | De Prisco . | |
| 3,491,250 | 1/1970 | Shob . | |
| 3,582,733 | 6/1971 | Brubaker | 310/316 X |
| 3,622,960 | 11/1971 | Malba et al. | 367/137 |
| 3,715,649 | 2/1973 | Ravas . | |
| 3,715,710 | 2/1973 | Berstein et al. | 367/137 |
| 3,979,660 | 9/1976 | Moore . | |
| 4,044,297 | 8/1977 | Nobur et al. | 310/317 X |
| 4,271,705 | 6/1981 | Crostack | 367/137 |
| 4,277,710 | 7/1981 | Harwood et al. | 318/118 X |
| 4,282,452 | 8/1981 | Hassler et al. | 367/137 |
| 4,347,592 | 8/1982 | Langeraar | 367/138 |
| 4,504,762 | 3/1985 | Meyer et al. | 367/137 |

FOREIGN PATENT DOCUMENTS

| | | |
|---|---|---|
| 0187282 | 7/1986 | European Pat. Off. . |
| 0274136 | 7/1988 | European Pat. Off. . |

OTHER PUBLICATIONS

Sun Luin Kuo, "Half-Bridge Transistor Inverter for DC Power Conversion," *IEEE Transactions on Industrial Electronics and Control Instrumentation,* IECI-21:4 (11/74).

*Primary Examiner*—Thomas H. Taroza
*Assistant Examiner*—Tod Swann
*Attorney, Agent, or Firm*—Limbach, Limbach & Sutton

[57] ABSTRACT

A regulated ultrasonic generator operable for supplying a driving signal to an ultrasonic transducer is disclosed. The generator includes: a power supply; a bridge inverter circuit for generating a power signal having two alternating components of opposite potential; a timing circuit for generating a timing signal equal in frequency to the desired frequency of the power signal; a bridge driver circuit for periodically generating base drive signals for switching on the bridge inverter circuit; a bridge modulating circuit for controlling the amount of time during each cycle that the bridge inverter circuit is on so as to regulate the power content of the power signal; and means for supplying the power signal to the ultrasonic transducer.

28 Claims, 8 Drawing Sheets

REGULATED ULTRASONIC GENERATOR

BACKGROUND OF THE INVENTION

1. Field of the Invention

This invention relates generally to ultrasonic cleaning equipment, and relates more particularly to a regulated ultrasonic generator operable for supplying a driving signal to an ultrasonic transducer.

2. Description of the Relevant Art

The process of ultrasonic cleaning includes the steps of immersing a part to be cleaned in a suitable liquid medium, and agitating that medium with high-frequency sound energy for a short period of time. The high-frequency sound energy produces alternating rarefactions and compressions of the liquid. Small vapor cavities or bubbles form through cavitation during rarefactions and collapse during compressions. The formation and collapse of the vapor cavities create shock waves that impinge on the surface of the part and, through a scrubbing action, displace or loosen particulate matter.

The high-frequency sound energy is typically produced by some form of a displacement transducer, such as ferromagnetic or piezoelectric, that converts an electrical driving signal into mechanical motion. The electrical driving signal is generated and supplied to the ultrasonic transducer by an ultrasonic generator. One factor that affects the degree of scrubbing action of an ultrasonic cleaner is the frequency of the sound energy, which commonly ranges between 20 KHz and 120 KHz. The size and number of the cavitation cavities varies with the frequency of the sound energy, with higher frequencies producing more numerous cavities of smaller size than lower frequencies. The selection of an optimum frequency is difficult because it varies with each cleaning application.

Another factor that affects ultrasonic cleaning is the amplitude of the sound energy, which is proportional to the electrical energy supplied to the ultrasonic transducer. In order for cavitation to occur in a liquid medium, the amplitude of the sound energy must exceed a certain threshold value. The application of sound energy over and above this threshold value causes an increase in the overall quantity of the cavitation cavities, which may or may not be desirable for a particular cleaning application.

Still another factor that affects ultrasonic cleaning is the degree of entrapment of air in the liquid medium, which resists the collapse of the cavitation cavities and reduces the effectiveness of cleaning. The amount of entrapped air can be reduced by periodically switching off the ultrasonic transducer to permit adjacent air bubbles to coalesce, float to the surface, and escape, in a process known as degassing modulation.

Prior ultrasonic generators exhibit certain shortcomings that limit their effectiveness. One such shortcoming is that prior ultrasonic generators do not regulate the frequency and amplitude of the driving signal very closely, so that changes in the operational environment, such as the temperature or fluid level of the liquid medium, can produce an undesired shift in frequency or amplitude that, in turn, degrades cleaning performance. Another shortcoming is that many prior art ultrasonic generators do not offer protection against short circuit or open circuit operation. Under those conditions, such generators will blow fuses or even transistors.

SUMMARY OF THE INVENTION

In accordance with the illustrated preferred embodiment, the present invention provides a regulated ultrasonic generator operable for supplying a driving signal to an ultrasonic transducer. The generator includes: a power supply; a bridge inverter circuit powered by the power supply for generating a power signal having two alternating components of opposite potential, where the bridge inverter circuit includes four power transistors configured in two pairs thereof, and where each pair of power transistors generates one component of the power signal; a timing circuit for generating a timing signal equal in frequency to the desired frequency of the power signal; a bridge driver circuit responsive to the timing signal for periodically generating base drive signals that when supplied to the bases of the power transistors cause the power transistors to switch on; a bridge modulating circuit coupled between the bridge driving circuit and the bridge inverter circuit for selectively connecting the base drive signals to and disconnecting the base drive signals from the bases of the power transistors to define the amount of time during each cycle of the power signal that the power transistors are on so as to regulate the power content of the power signal; and means for supplying the power signal to the ultrasonic transducer.

Preferably, the bridge inverter circuit supplies the power signal to a transformer that reshapes the power signal to a sine wave and converts it to a voltage that is appropriate for the ultrasonic transducer. The timing and base driving circuits define the frequency of the power signal independently from the operation of the power signal generation portion of the generator, so that the frequency of operation is not affected by changes to the transducer or fluid. The bridge modulating circuit monitors the current of the power signal and modulates the power signal using a pulse width modulation technique in order to regulate its power. A soft-start circuit also modulates the power signal during the initial turn-on of the generator. Using an optional duty cycle controller, the generator can shut off the driving signal prior to the end of each power supply cycle to allow for degassing.

The regulated ultrasonic generator of the present invention includes several advantageous features. One feature is that both the frequency and the amplitude of the power signal are independently adjustable and independently regulated. Another feature is that the power/degassing duty cycle can be varied. Still another feature is that open circuit and short circuit protection is provided. A major advantage of the regulated ultrasonic generator of the present invention over prior generators is that the frequency and amplitude of the power signal is not effected by variations of the power supply, transducer, or fluid.

The features and advantages described in the specification are not all inclusive, and particularly, many additional features and advantages will be apparent to one of ordinary skill in the art in view of the drawings, specification and claims hereof. Moreover, it should be noted that the language used in the specification has been principally selected for readability and instructional purposes, and may not have been selected to delineate or circumscribe the inventive subject matter, resort to the claims being necessary to determine such inventive subject matter.

DETAILED DESCRIPTION OF THE PREFERRED EMBODIMENT

FIGS. 1 through 10 of the drawings depict various preferred embodiments of the present invention for purposes of illustration only. One skilled in the art will readily recognize from the following discussion that alternative embodiments of the structures and methods illustrated herein may be employed without departing from the principles of the invention described herein.

Figure 1:
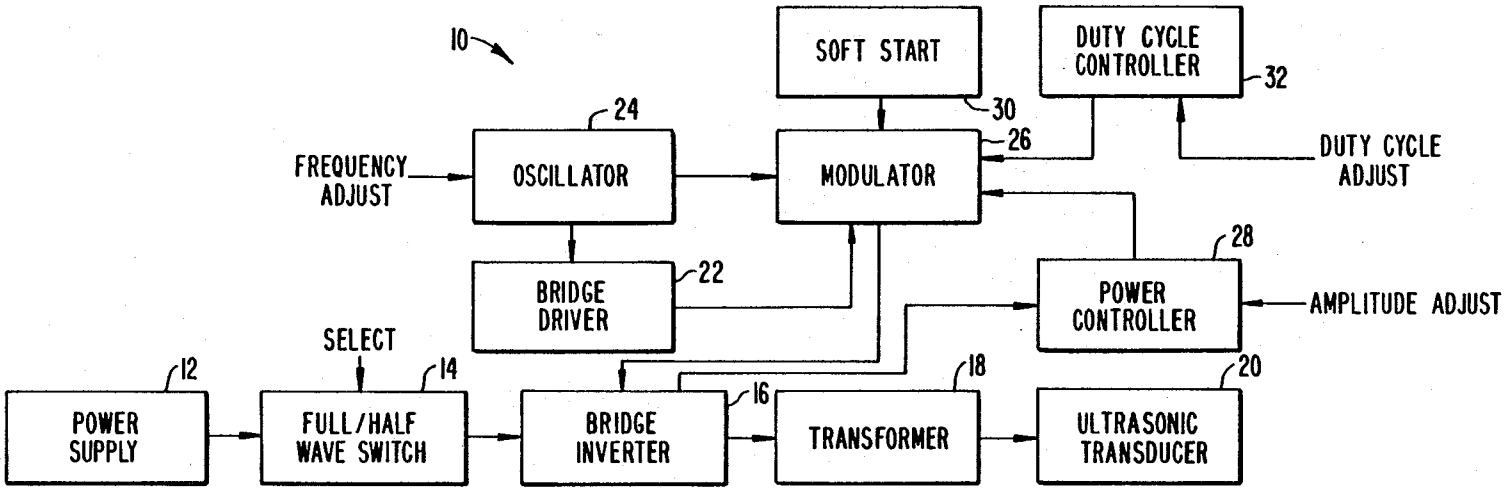
FIG. 1 is a block diagram of a regulated ultrasonic generator according to the present invention.

The preferred embodiment of the present invention is a regulated ultrasonic generator operable for supplying a driving signal to an ultrasonic transducer. A power portion of the regulated ultrasonic generator 10, as shown in FIG. 1, includes a power supply 12, a full/half wave switch 14, a bridge inverter 16, and a transformer 18 all connected in series and operable for supplying an ultrasonic driving signal to an ultrasonic transducer 20. A control portion of the generator 10 includes a bridge driver 22, an oscillator 24, a modulator 26, a power controller 28, a soft start circuit 30, and an optional duty cycle controller 32, all of which are coupled either directly or indirectly to the bridge inverter 16. The individual schematic diagrams of the component elements of the generator 10, as seen in FIGS. 2 through 9, will be described below, starting with the power portion of the generator and then shifting to the control portion.

Figure 2:
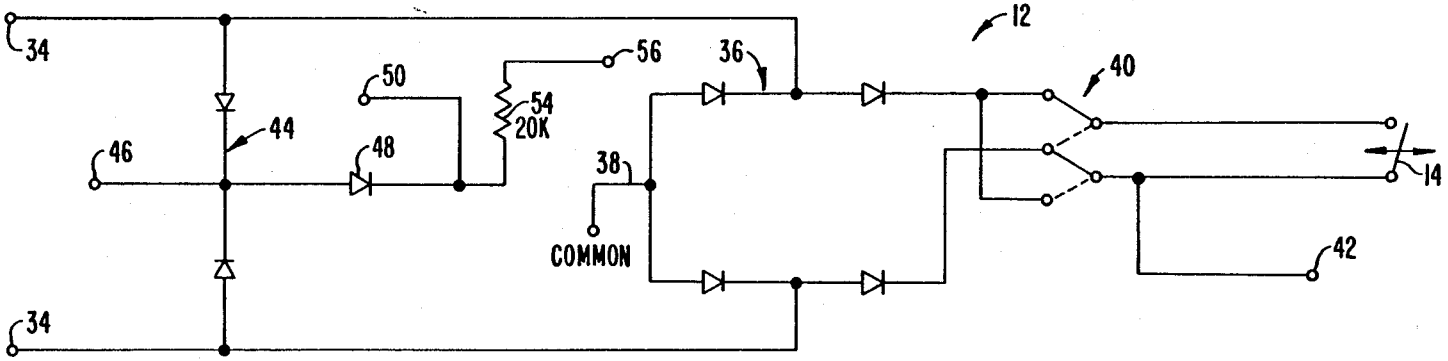
FIG. 2 is a schematic diagram of a power supply circuit of the regulated ultrasonic generator.
Figure 3:
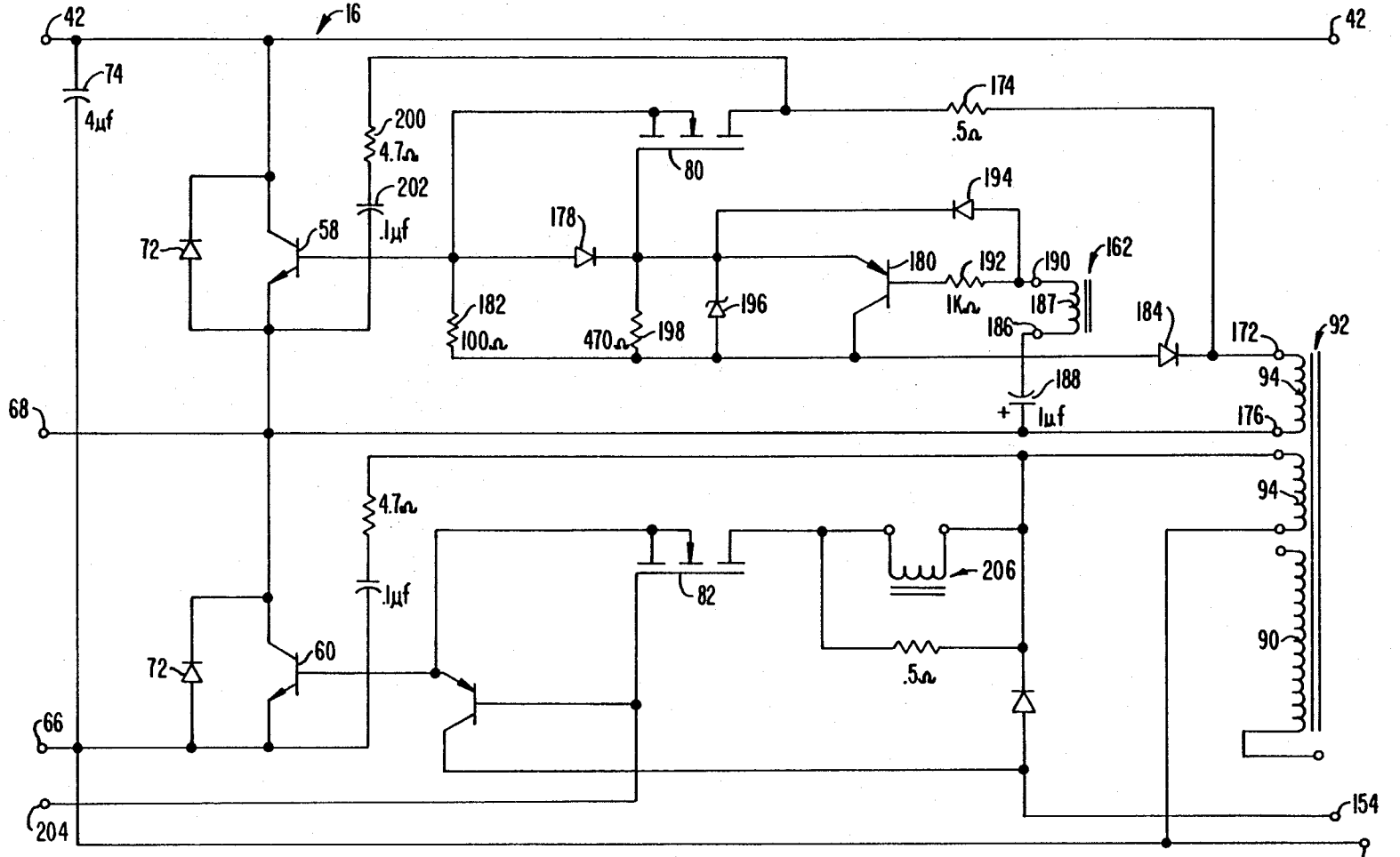
FIG. 3 is a schematic diagram of one half of a bridge inverter circuit and portions of a base driver circuit and a bridge modulating circuit of the regulated ultrasonic generator.
Figure 9:
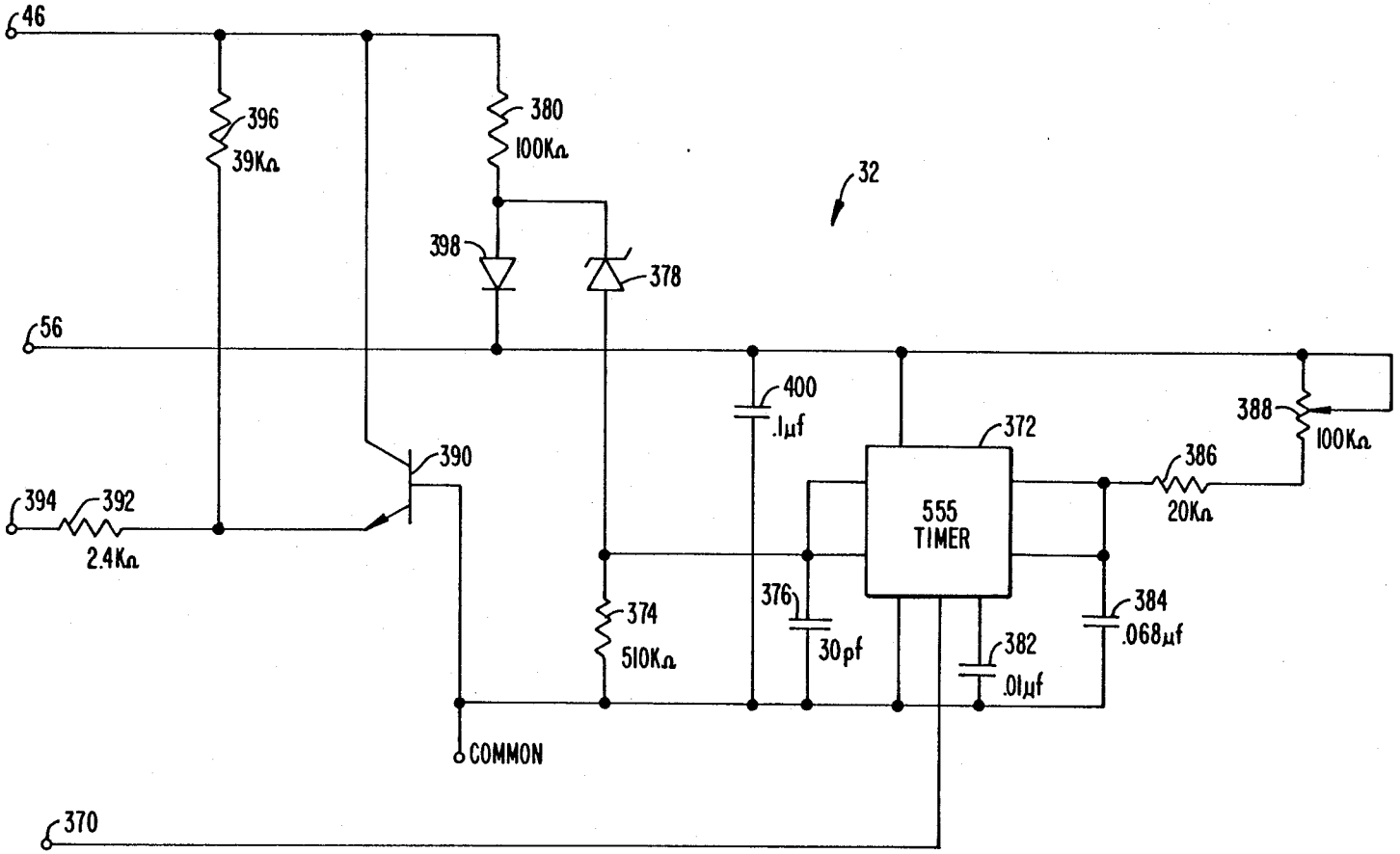
FIG. 9 is a schematic diagram of a duty cycle controller of the regulated ultrasonic generator.

The power supply 12, as shown in FIG. 2 receives input power from a single-phase alternating-current power source via input terminals 34. Preferably, the input power is fused and filtered prior to entering the power supply 12. From the input terminals 34, the input power is rectified by a full wave diode bridge rectifier 36. The negative side 38 of the output half of the diode bridge 36 is connected to common, while the positive side is connected through a switch 40 to the full/half wave switch 14. From the switch 14, the rectified signal is supplied through output terminal 42 to the bridge inverter 16 (FIG. 3). If the full/half wave switch 14 is closed, the signal on the output terminal 42 is rectified and has a frequency of twice the frequency of the AC input power signal. In such case, the frequency of the signal at terminal 42 will equal 120 Hz, assuming that the AC input power has a frequency of 60 Hz. If the full/half wave switch 14 is open, the signal on the output terminal 42 resembles the positive half of the AC input power signal. The switch 40 determines which half of the AC input power signal is supplied to the output terminal 42 when the full/half wave switch 14 is open. In parallel with the diode bridge 36 is another diode rectifier 44 that supplies rectified power at node 46 for connection to the duty cycle controller 32 (FIG. 9). From the midpoint of the diode rectifier 44, a diode 48 supplies rectified power to the bridge driver 22 (FIG. 6) via a node 50 and to a DC power supply 52 (FIG. 7) via a series-connected resistor 54 and a node 56.

Figure 4:
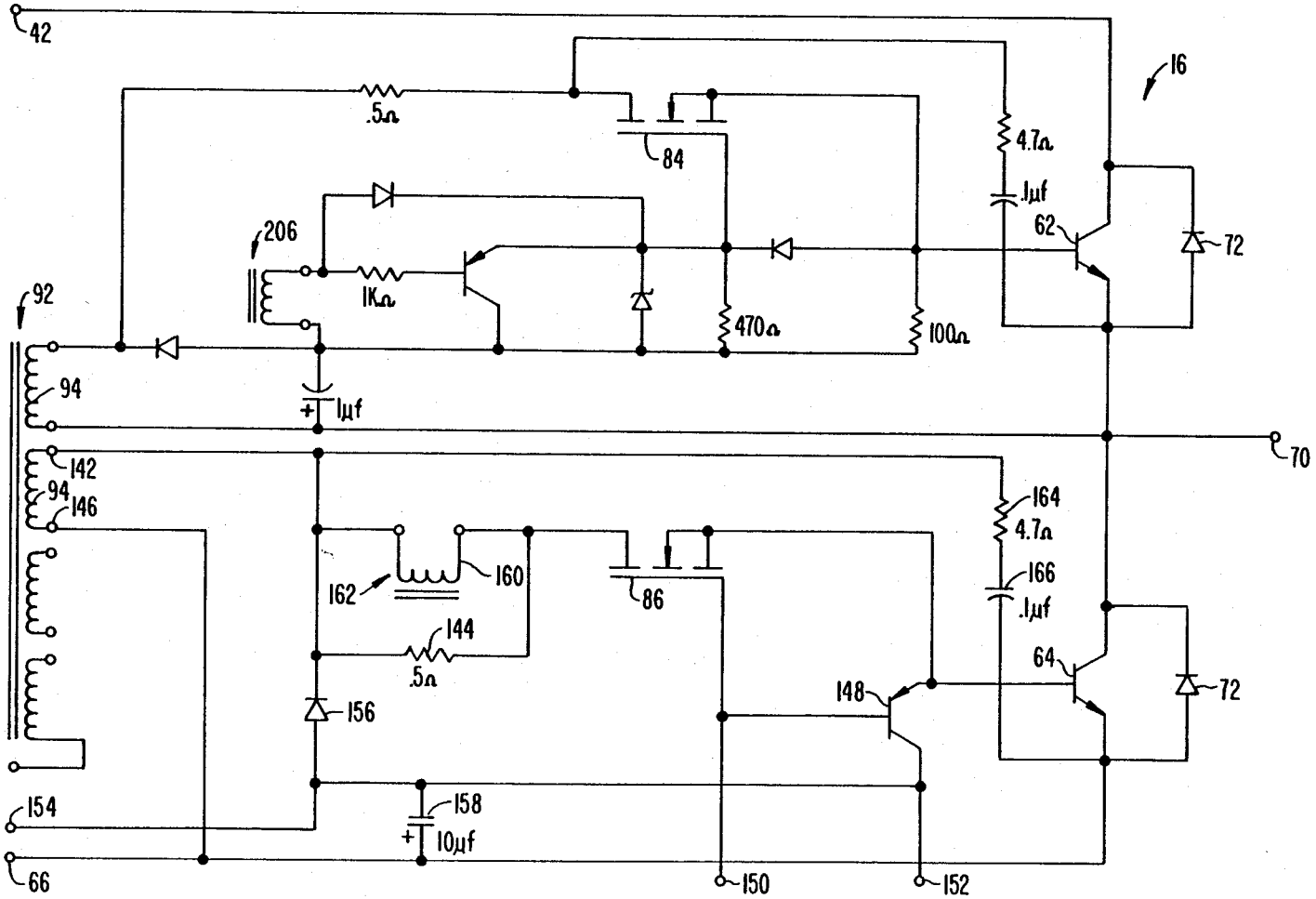
FIG. 4 is a schematic diagram of the other half of the bridge inverter circuit and additional portions of the base driver and bridge modulating circuits of the regulated ultrasonic generator.
Figure 7:
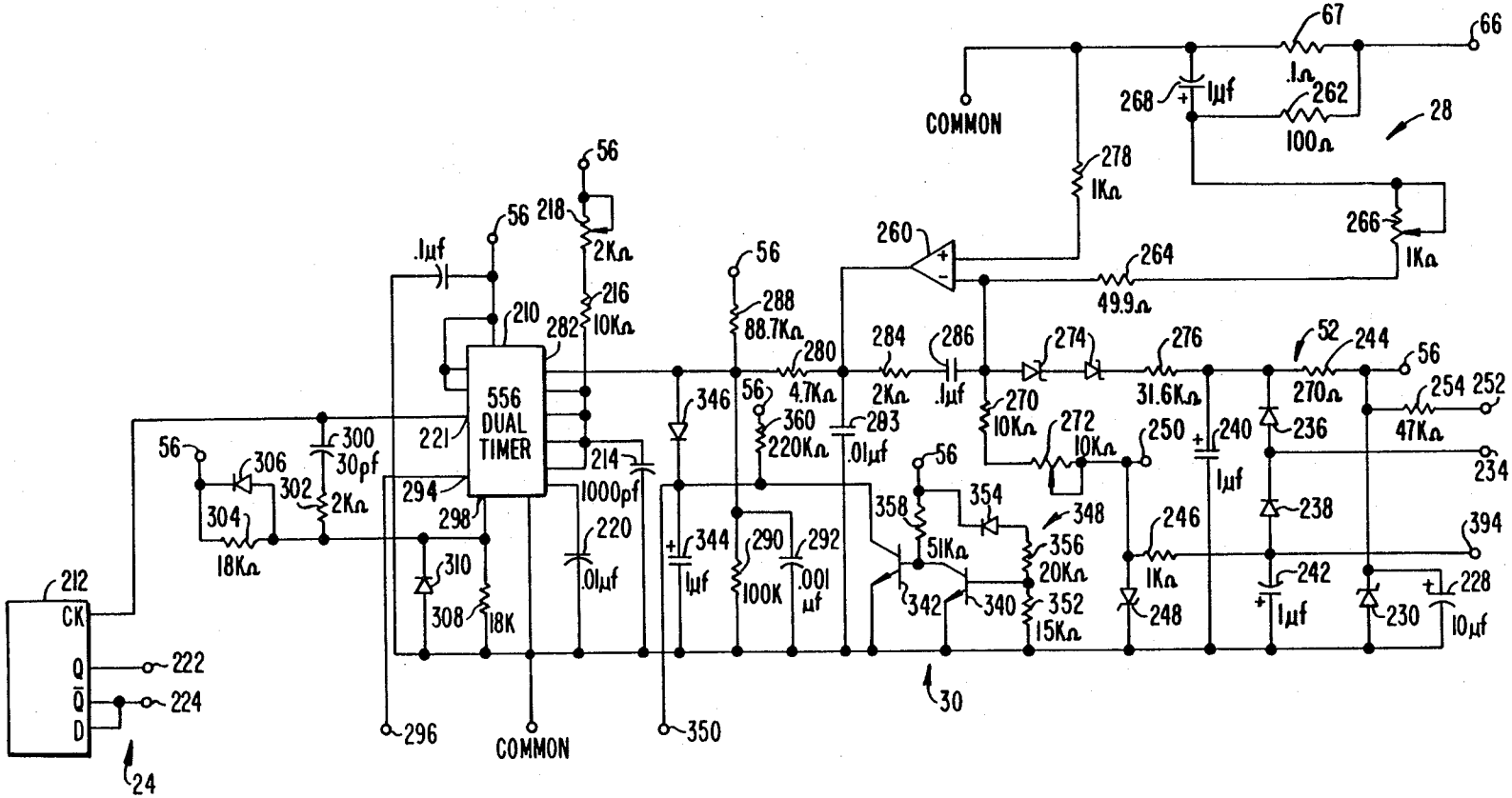
FIG. 7 is a schematic diagram of another portion of the bridge modulating circuit of the regulated ultrasonic generator.

The bridge inverter 16, as illustrated in FIGS. 3 and 4, includes four power transistors 58, 60, 62, and 64 connected in a bridge configuration between the output terminal 42 of the power supply 12 and node 66. Node 66, as shown in FIG. 7, is slightly above common potential due to the 0.1 ohm series-connected resistor 67, which is used for current sensing by the power controller 28. All of the power transistors 58, 60, 62, and 64 are preferably bipolar transistors of the same polarity, preferably NPN, as shown. The collectors of transistors 58 and 62 are connected to terminal 42, while the emitter of transistor 58 is connected to a node 68 and the emitter of transistor 62 is connected to a node 70. The emitters of transistors 60 and 64 are connected to node 66, while the collector of transistor 60 is connected to node 68 and the collector of transistor 64 is connected to node 70. Four diodes 72 are connected across the power transistors to protect against induced reverse voltages. A filter capacitor 74 is connected between terminal 42 and node 66 for attenuating the high-frequency switching noise generated by the bridge inverter 16.

Figure 5:
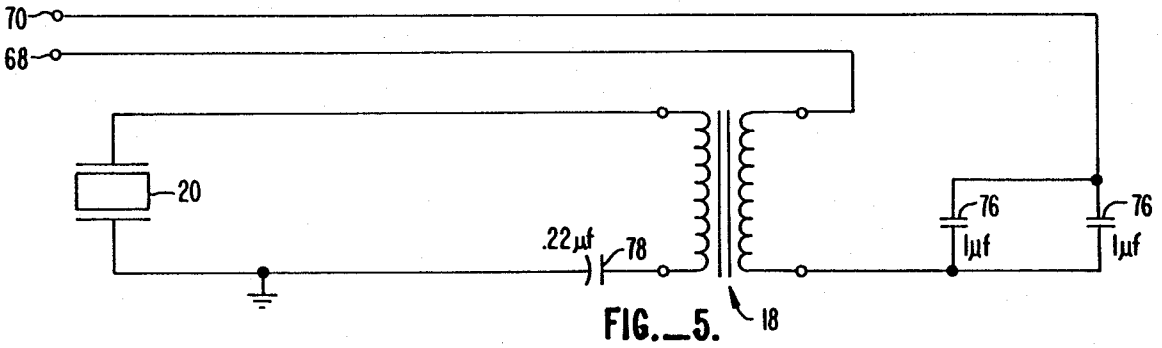
FIG. 5 is a schematic diagram of an output transformer stage of the regulated ultrasonic generator.

The bridge inverter 16 converts the 120 Hz full-wave power signal supplied by the power supply 12 into a high-frequency power signal for supplying to the ultrasonic transducer 20. Node 68 is connected directly to one terminal of the primary winding of transformer 18, as shown in FIG. 5, while node 70 is coupled through parallel capacitors 76 to the other terminal of the primary winding of transformer 18. The secondary winding of the transformer 18 is coupled to the ultrasonic transducer 20, with a series-connected capacitor 78 inserted in one connecting line between the transducer and the transformer.

By means described below, the power transistors 58, 60, 62, and 64 are alternately switched on and off by the bridge driver 22 and the modulator 26 at a high-frequency rate, which in the illustrated preferred embodiment is about 40 KHz. The power transistors are configured in two pairs, with transistors 58 and 64 forming one pair and transistors 60 and 62 forming the other pair. The pairs of power transistors are switched alternately; in other words, the transistor pair 58–64 is switched on and transistor pair 60–62 is switched off during one half of the high-frequency cycle, and during the other half of the high-frequency cycle the transistor pair 58–64 is switched off and the transistor pair 60–62 is switched on. The above statement should be qualified in that the bridge driver 22 permits each transistor pair to be switched on during its corresponding half of the high-frequency cycle, but the modulator 26 may limit the duration that the transistor pair is switched on to something less than a full half cycle, or may inhibit entirely the switching on of the transistor pair.

When transistor pair 58–64 is switched on, current flows from terminal 42, through transistor 58, through node 68 and through the transformer 18, and then flows through node 70 and transistor 64 to node 66, which, as stated above, is slightly above common potential. Conversely, when transistor pair 60–62 is switched on, current flows from terminal 42, through transistor 62, through node 70 to the transformer 18, and then flows through node 68 and transistor 60 to node 66. Thus, the bridge inverter supplies an alternating current at the high-frequency to the transformer 18, with each pair of power transistors generating one component thereof.

The transformer 18 provides the necessary step-up in signal voltage to drive the transducer 20, and also provides isolation between the generator 10 and the transducer. In addition, the transformer 18 preferably is designed to have a leakage inductance between the primary and secondary windings, which limits the current into the capacitive transducer 20, thereby transforming the power signal supplied by the bridge inverter 16 into a driving signal that approximates a sine wave.

Figure 6:
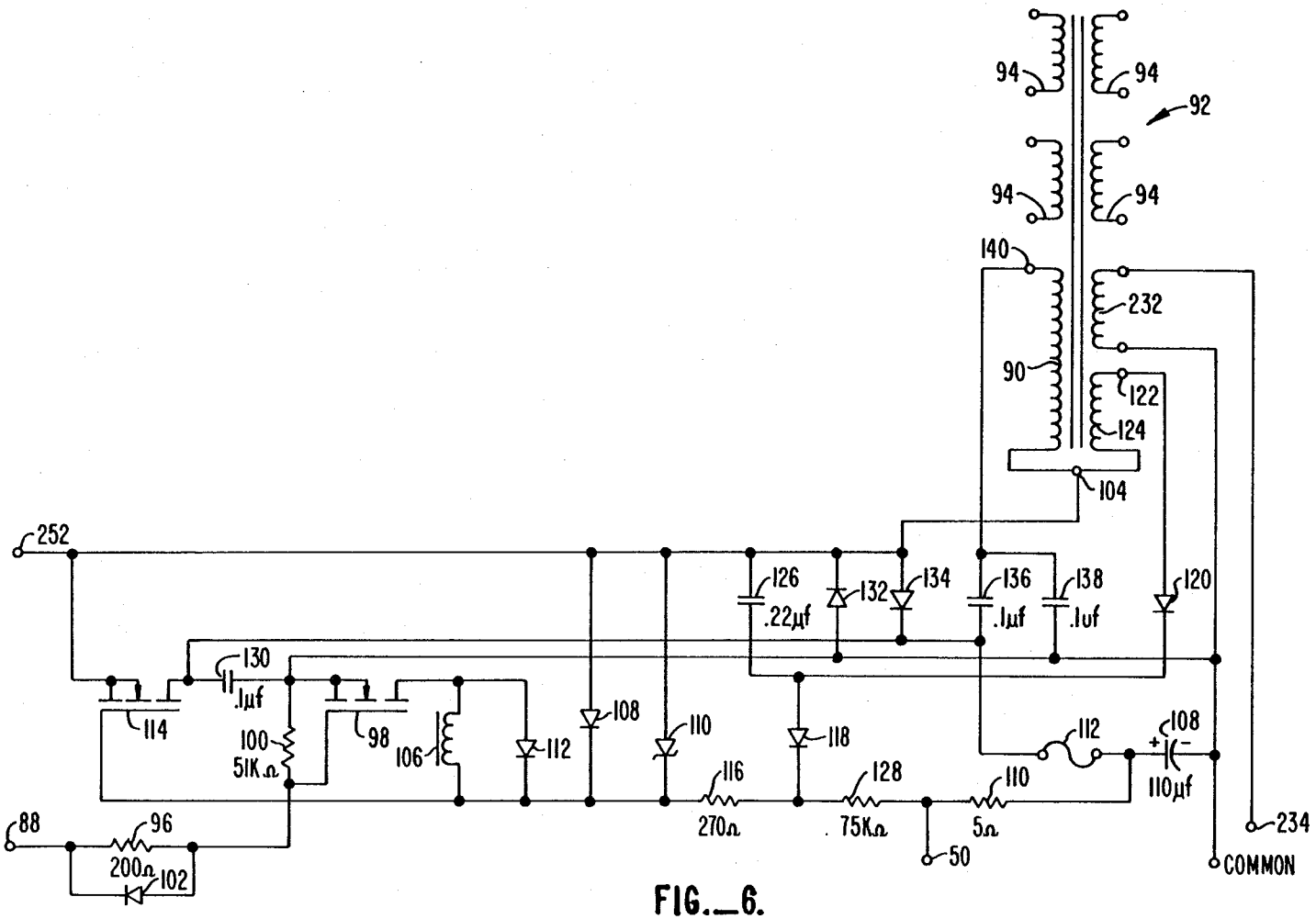
FIG. 6 is a schematic diagram of another portion of the bridge driver circuit of the regulated ultrasonic generator.

The base driver circuit 22, shown in FIGS. 3, 4, and 6, generates base drive signals to be supplied through modulating transistors 80, 82, 84, and 86 of the modulator 26 to the bases of the power transistors 58, 60, 62, and 64 for switching the power transistors at the high-frequency rate. In reference now to FIG. 6, a high-frequency timing signal is generated by the oscillator 24 and supplied to node 88 of the bridge driver 22. The portion of the bridge driver circuit that is illustrated in FIG. 6 drives the primary winding 90 of a bridge driving transformer 92 at the high-frequency rate with an alternating current to induce base drive signals in four secondary windings 94. Node 88 is coupled through resistor 96 to the gate terminal of a first bridge driving transistor 98, and from there is coupled to common through resistor 100. The resistor 96 and a parallel connected diode 102 comprise a wave-shaping network for modifying the wave shape of the square-wave timing signal applied to node 88. The source terminal of the transistor 98 is connected to common, while the drain terminal of the transistor is coupled to one terminal 104 of the primary winding 90 through an inductor 106 and a diode 108. A diode 110 is connected in parallel with diode 108, while another diode 112 is connected in parallel across the inductor 106. When transistor 98 is switched on, it effectively connects to common the terminal 104 of the primary winding 90.

The primary winding 90 of the transformer 92 is supplied an alternating current based on an electrical charge stored in a capacitor 108. One side of the capacitor 108 is connected to common, while the positive side is coupled to node 50 of the power supply 12 through a low-resistance resistor 110, which continuously charges the capacitor. The positive side of the capacitor 108 is also coupled through a fuse 112 to the drain terminal of a second bridge driving transistor 114. Preferably, both bridge driving transistors 98 and 114 are field-effect transistors. The source terminal of the transistor 114 is connected to terminal 104 of the primary winding 90. The gate terminal of the transistor 114 is coupled through a resistor 116 and two diodes 118 and 120 to a terminal 122 of a secondary winding 124 of the transformer 92. The diode 110 is a zener diode that protects the gate of transistor 114 from an over-voltage condition. The other terminal of the secondary winding 124 is connected to terminal 104 of the primary winding 90. The common connection between the diodes 118 and 120 is connected to one side of a capacitor 126, which is connected at the other side thereof to terminal 104 of the primary winding 90. A high resistance resistor 128 is connected between node 50 and the common connection between resistor 116 and diode 118. The drain terminal of transistor 114 is coupled to common through a capacitor 130 to suppress transients. Clamping diodes 132 and 134 restrict the voltage swings of terminal 104 of the primary winding 90, with diode 132 being connected between terminal 104 and common, and with diode 134 being connected between terminal 104 and the positive side of capacitor 108. Capacitors 136 and 138 keep the voltage applied to terminal 140 of the primary winding 90 at a mid-point between the voltages that are alternately applied to terminal 104, with capacitor 136 being coupled between terminal 140 and the positive side of capacitor 108, and with capacitor 138 being coupled between terminal 140 and common.

In operation, the timing signal applied at node 88 causes transistor 98 to alternately switch on and off at the high-frequency rate. When transistor 98 is switched on, any charge on terminal 104 of the primary 90 will flow through diode 108 and inductor 106 and through transistor 98 to common. The inductor 106 limits the voltage spikes that would otherwise be present due to the inductance of the transformer 92. During this time, current induced in the secondary winding 124 is stored in capacitor 126. When the timing signal goes low and the transistor 98 is switched off, current flows from capacitor 126 and through diode 118 and resistor 116 to pull up the voltage applied to the gate of transistor 114, thus switching on transistor 114. When transistor 114 is on, current flows from the positive side of the capacitor 108, through fuse 112 and transistor 114 to terminal 104. Since the capacitors 136 and 138 keep the voltage at terminal 140 of the primary winding 90 at an intermediate voltage, such switching of the transistors 98 and 114 creates an alternating current through the primary winding 90, which in turn induces alternating currents in the secondaries 94 that generate the base drive signals.

Turning attention back to FIGS. 3 and 4, the remainder of the bridge driver circuitry 22 can now be described. As described above, alternating voltages are induced in the secondary windings 94 of the transformer 92. In reference first to the base drive circuitry associated with power transistor 64, one terminal 142 of the secondary winding 94 is coupled through a resistor 144 and a modulating transistor 86 to the base of power transistor 64, while the other terminal 146 of the secondary winding is connected to node 66, which is near common potential. The source of the modulating transistor 86 is connected to the base of the power transistor 64 and is also connected to the emitter of a PNP transistor 148. The base of the transistor 148 is connected to the gate of the modulating transistor 86 and to a node 150 that receives a first modulating signal that controls the switching of the transistors 86 and 148. The collector of the transistor 148 is coupled through node 152 and a capacitor 153 to common (see FIG. 8), is connected to the FIG. 3 portion of the bridge driver circuitry through node 154, and is coupled to terminal 142 of the secondary 94 through a diode 156 and to node 66 through a capacitor 158. The primary winding 160 of a transformer 162 is connected in parallel across resistor 144. In odder to suppress transients, a resistor 164 and a capacitor 166 are connected in series between the terminal 142 and node 66.

The first modulating signal, which controls the operation of the modulating transistor 86 and the PNP transistor 148, is applied to the gate of transistor 86 and the base of transistor 148 through node 150. At the beginning of a half-cycle, when a positive voltage exists at terminal 142 of the secondary and the modulating transistor 86 is switched on and transistor 148 is switched off by a logic high voltage applied through node 150, current flows through the resistor 144 and the modulating transistor to turn on the power transistor 64. When the modulating transistor is switched off by a logic low voltage applied at node 150, transistor 148 switches on to rapidly switch off the power transistor 64. The power transistor 64 then remains switched off through the remainder of the half-cycle and through the succeeding half-cycle that turns on power transistor pair 60–62. The modulating transistor 86 thus serves as a switch connected in series between the bridge driver transformer 92 and the power transistor 64 and is operable for selectively coupling the base drive signal generated by the secondary winding 94 to the base of the power transistor.

The power transistors 58 and 64 are coupled together as a pair, with transistor 64 being controlled directly by the first modulating signal applied to node 150, and with transistor 58 being configured to follow the operation of transistor 64. In reference now to the circuitry associated with power transistor 58, one terminal 172 of the secondary winding 94 is coupled through a limiting resistor 174 and a modulating transistor 80 to the base of power transistor 58, while the other terminal 176 of the secondary winding is connected to node 68. The source of the modulating transistor 8 is connected to the base of the power transistor 58 and is also coupled through a diode 178 back to the gate of the transistor 80, to the emitter of a PNP transistor 180, and through a resistor 182 and diode 184 back to terminal 172 of the secondary 94. The anode of diode 184 is also connected to one terminal 186 of the secondary winding 187 of transformer 162 and to the collector of transistor 180, and is coupled through a capacitor 188 to node 68. The other terminal 190 of the secondary winding 187 is coupled through a resistor 192 to the base of the transistor 180 and through a diode 194 to the gate of the modulating transistor 80. A zener diode 196 is coupled between the terminal 186 and the gate of the modulating transistor 80 to provide over-voltage protection to the gate. A resistor 198 is connected in parallel to the diode 196 and provides, in combination with resistors 182 and 192, diodes 178 and 184, and capacitor 188, a biasing network for the transistors 58, 80, and 180. In order to suppress transients, a resistor 200 and a capacitor 202 are connected in series between the drain of the modulating transistor 80 and node 68.

When the first modulating signal, which is applied to node 150, switches on the modulating transistor 86, current flows through the resistor 144 and the modulating transistor to turn on the power transistor 64. The base current of the power transistor 64 flows through the transformer 162 and induces a current in the secondary winding 187 thereof that flows through diode 194 and switches on the modulating transistor 80 and switches off the transistor 180. With the modulating transistor 80 switched on, the current generated in the secondary winding 94 flows through resistor 174 and the now-conductive modulating transistor 80 to the base of the power transistor 58, switching it on. Thus, the first modulating signal applied to node 150 causes both power transistors 58 and 64 to switch on. Note that during this half- cycle, the power transistor pair 60–62 is switched off due to the opposite polarity of the base drive signals generated by their associated secondaries 94.

When the modulating transistor 86 is switched off by a logic low voltage applied at node 150, current stops flowing through the transformer 160, causing the PNP transistor 180 to switch on and the modulating transistor 80 to switch off, thereby switching off the power transistor 58. The power transistors 58 and 64 then remain switched off through the remainder of the half-cycle and through the succeeding half-cycle that turns on transistor pair 60–62. The modulating transistor 80 thus serves as a switch connected in series between the bridge driver transformer 92 and the power transistor 58 and operable for selectively coupling the base drive signal generated by the secondary winding 94 to the base of the power transistor.

The power transistors 60 and 62 are coupled together as a pair in the same manner as described above in connection with power transistors 58 and 64. The modulating transistor 82 is controlled directly by a second modulating signal applied through node 204 to the gate of transistor 82, while the other modulating transistor 84 is controlled indirectly through transformer 206 and follows the operation of transistor 82. The secondaries 94 of the bridge driver transformer 92 are configured such that the base drive signals generated for the power transistor pair 58–64 are opposite in polarity to the base drive signals generated for the other power transistor pair 60–62 so that the two transistor pairs can be switched on only during alternate half-cycles.

Figure 8:
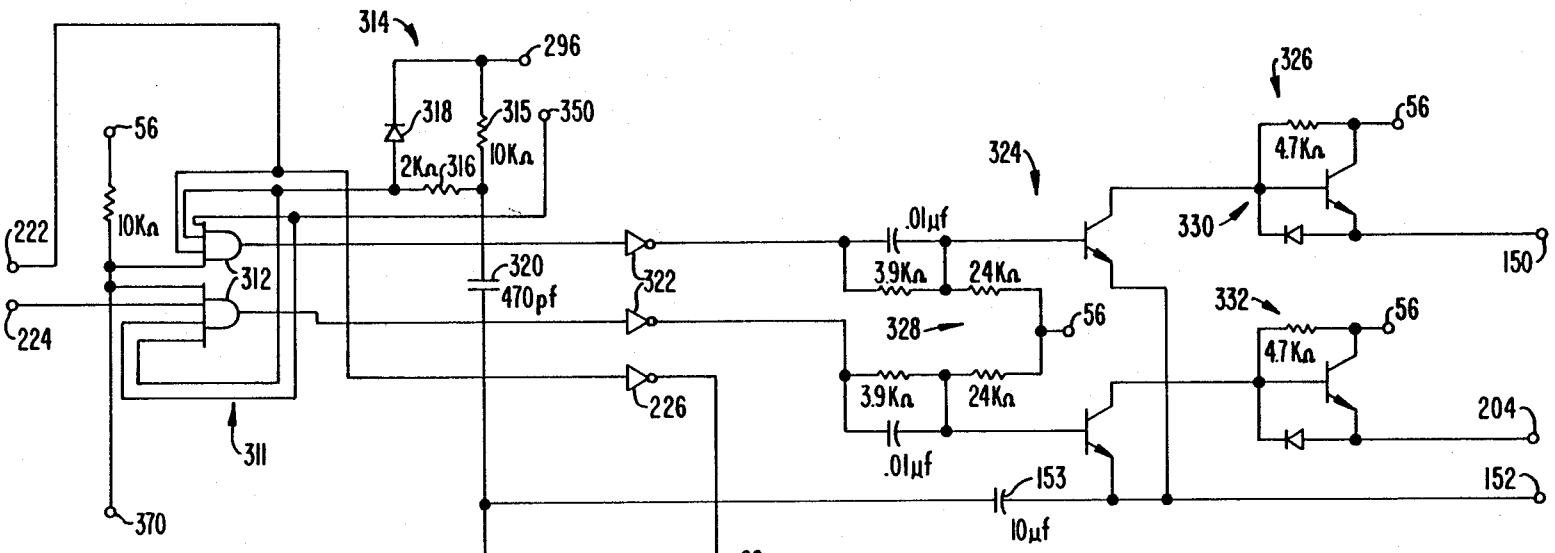
FIG. 8 is a schematic diagram of the remainder of the bridge modulating circuit of the regulated ultrasonic generator.
Figure 10:
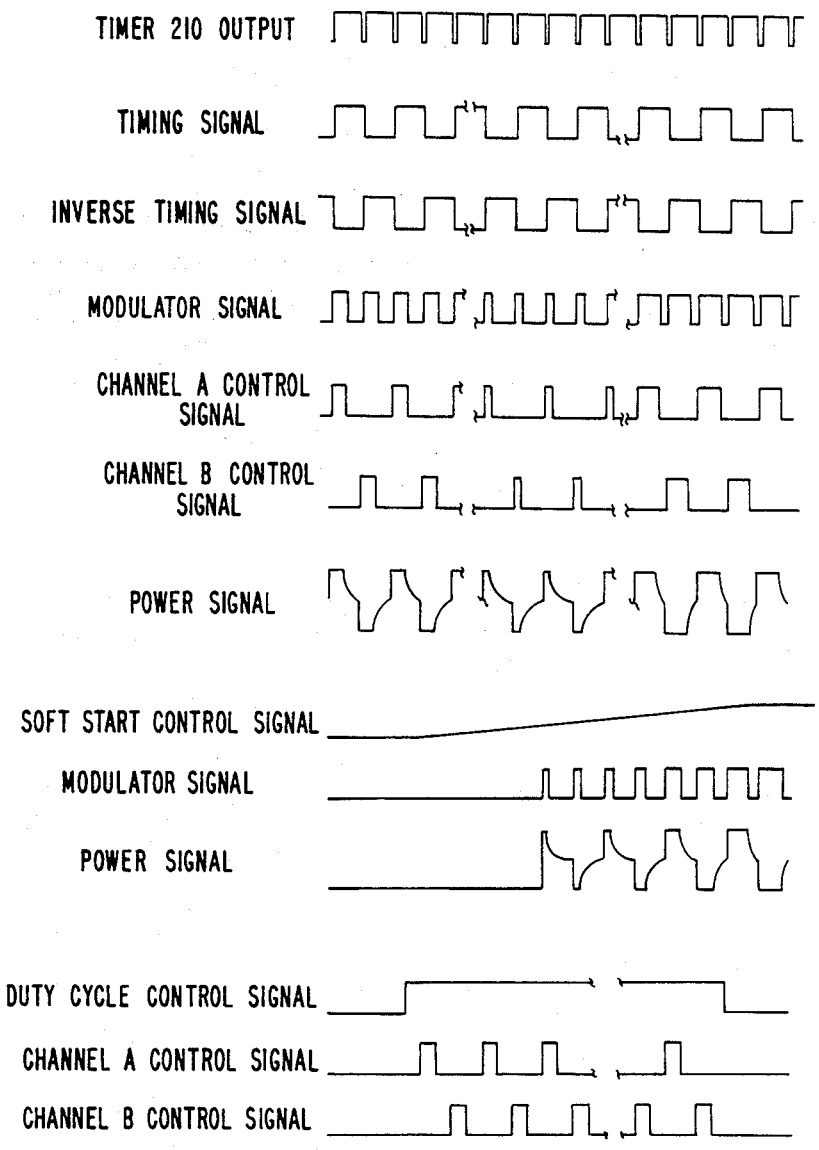
FIG. 10 is a diagram of various signals present throughout the regulated ultrasonic generator.

The circuitry of the oscillator 24, illustrated in FIG. 7, includes a timer 210 and a D-type flip-flop 212. The timer 210, which is preferably one half of a 556 dual timer, is powered by the positive DC voltage available at node 56, which is also applied to the reset terminal of the timer. The timer 210 is configured as an astable oscillator, with the discharge, threshold, and trigger terminals coupled through a timing capacitor 214 to common and through a fixed resistor 216 and an adjustable resistor 218 to the positive voltage at node 56. The RC value of resistors 216 and 218 and capacitor 214 determine the frequency of the output signal of the timer 210. The control terminal of the timer 210 is coupled to common through capacitor 220, while the output terminal 221 of the timer 210 is connected to the clock input terminal of the flip-flop 212. One output terminal of the flip-flop 212 supplies a timing signal to node 222, while the inverse output terminal supplies an inverse timing signal to node 22 and to the D input terminal of the flip-flop. The frequency of the output signal of the timer 210 is adjusted by changing the resistance of the adjustable resistor 218 until the timer frequency is twice the desired frequency of the power signal. The timing and inverse timing signals are square waves equal in frequency to the desired frequency. The waveforms for the timer output signal and the timing signals are shown in FIG. 10. In the illustrated preferred embodiment, the timer output signal is an 80 KHz signal, while the timing signal output of the flip-flop 212 is a 40 KHz square-wave. As shown in FIG. 8, the timing signal at node 222 is coupled through an inverter 226 to node 88, which is the entry point for the timing signal in the bridge driver 22, shown in FIG. 6.

The DC power supply 52, illustrated in FIG. 7, generates positive and negative DC power for the control circuitry of the generator 10. The input power supplied to the generator 10 is rectified through diode rectifier 44 (FIG. 2) and diode 48, and flows through resistor 54 to node 56. As seen in FIG. 7, node 56 is coupled to common through a parallel-connected capacitor 228 and zener diode 230, the breakdown voltage of which determines the voltage at node 56. The positive voltage at node 56 is supplied to various parts of the circuitry, as shown, and starts the timer 210 oscillating, which through the flip-flop 212 supplies the timing signal to node 88. The timing signal causes the two bridge driving transistors 98 and 114 of the bridge driver circuit 22 to switch on and off, which in turn applies an alternating current to the primary winding 90 of the transformer 92 (FIG. 6). Current is induced in a secondary winding 232, which supplies an alternating potential through node 234 to the common junction between diodes 236 and 238 (FIG. 7). This alternating potential is rectified by diode 236 into positive voltage and by diode 238 into negative voltage. Capacitors 240 and 242 serve as filter capacitors, while resistors 244 and 246 serve as current limiting resistors. The zener diode 248 regulates the negative voltage at node 250 to a fixed amount relative to common. During the initial start-up, additional current is supplied to node 56 from the primary 90 of transformer 92 through node 252 and resistor 254.

The modulator 26 and the power controller 28, shown in FIGS. 7 and 8, determine how long each power transistor pair is switched on during each half-cycle. The power controller 28 senses the current of the power signal supplied to the transformer 18 to drive the ultrasonic transducer 20, and compares that sensed current to a reference that indicates the desired current of the power signal. More specifically, the power controller 28 senses the voltage drop across the low-resistance resistor 67, which is connected in series between node 66 and common. The voltage upstream of the current-sensing resistor 67 is coupled to the negative terminal of a voltage comparator 260 through fixed resistors 262 and 264 and adjustable resistor 266. Resistor 262 and a capacitor 268 that is connected between common and resistor 262 filter the pulsating current through the current-sensing resistor 67 to create a DC signal. The negative terminal of the voltage comparator 260 is also coupled to the negative DC voltage at node 250 through a fixed resistor 270 and an adjustable resistor 272, so that, the voltage upstream of the resistor 67 is coupled through a voltage divider or resistor ladder to the voltage comparator. Also, the negative terminal of the voltage comparator 260 is coupled to the positive DC voltage at node 56 through a clamping network consisting of two zener diodes 274 and resistors 276 and 244. The positive terminal of the voltage comparator 260 is coupled to common through a resistor 278 to provide a reference voltage to the comparator downstream of the current-sensing resistor 67.

As current flows through the current-sensing resistor 67, the voltage drop across the resistor is equal to the current times the resistance of the resistor, thus, relative to common, the voltage upstream of the resistor 67 is a measure of the current flowing therethrough. The voltage that is applied to the negative terminal of the voltage comparator 260 is shifted downward toward the negative DC voltage at node 250 by the action of the resistor ladder. For a given current through the resistor 67, the exact voltage applied to the negative input terminal of the comparator 260 is determined by the settings of the adjustable resistors 266 and 272. Preferably, resistor 272 is factory adjusted to calibrate the power controller 26, while resistor 266 is operator adjusted to select the power output of the generator 10. When the current flowing through the resistor 67 is at its desired level, the voltage applied to the negative input terminal of the comparator 260 by the resistance ladder is equal to common potential.

The voltage comparator 260 generates a current error signal that indicates whether the current of the power signal is less than or greater than desired. The output terminal of the voltage comparator 260 is coupled through a resistor 280 to the control input terminal of a timer 282, which is preferably the other half of the 556 dual timer that contains timer 210. Between the comparator 260 and the resistor 280, the output terminal of the comparator is coupled to common via a filter capacitor 283, and is coupled back to the input terminal of the comparator through a series connected resistor 284 and capacitor 286, all of which provides a stabilizing filter that converts the digital output signal of the comparator into an analog signal that indicates the current error. Additional signal conditioning of this analog signal is performed by a resistor ladder consisting of resistor 288 connected between the positive DC voltage at node 56 and the control terminal of the timer 282, and resistor 290 and capacitor 292 connected in parallel between the control terminal of the timer and common.

The timer 282 responds to the current error signal generated by the voltage comparator 260 and its associated circuitry to generate a modulator signal, which is supplied through the output terminal 294 of the timer to node 296. The threshold terminal of the timer 282 is connected to the common connection between resistor 216 and capacitor 214, so that the same sawtooth voltage is applied to both timers 210 and 282. The trigger terminal 298 of the timer 282 is coupled to the output terminal 221 of timer 210 through a network consisting of a capacitor 300 and a resistor 302 connected in series between terminal 221 and terminal 298, with terminal 298 also coupled to the positive DC voltage at node 56 through a resistor 304 and a parallel clamp diode 306 and coupled to common through a resistor 308 and a parallel clamp diode 310. The timer 282 is triggered at the same rate as the timer 210 output signal, that is, twice the frequency of the timing signal.

The voltage of the current error signal generated by the comparator 260 and applied to the control terminal of the timer 282 determines the length of the pulses in the modulator signal generated by the timer 282. When the current error signal is at a relatively high voltage, which corresponds to the case where the current of the power signal is significantly less than desired, the modulator signal remains at the logic high voltage because the charge on the capacitor 214 never reaches the high control voltage needed to reset the output signal of the timer 282. When the current error signal is at a relatively low voltage, which corresponds to the case where the current of the power signal is more than desired, the modulator signal rises to the logic high voltage at the beginning of each pulse of the timer 210, but resets to the logic low voltage soon afterwards. In effect, the timer 282 provides pulse width modulation of the modulator signal under the control of the current error signal, with relatively narrow pulses signifying a power signal current in excess of that desired and relatively wide pulses signifying a power signal current that is less than desired. As explained below, the relatively narrow pulses of the modulator signal cause the power transistors of the bridge inverter to switch on for a relatively shorter period of time within each cycle to decrease the current of the power signal, while the relatively wide pulses of the modulator signal cause the power transistors to switch on for a relatively longer period of time within each cycle to increase the current of the power signal.

The modulator signal and the timing signal are logically combined by a two channel logic circuit 311, and the resultant control signals are amplified and supplied to the modulating transistors to control the on time of the power transistors of the bridge inverter 16. As shown in FIG. 8, the timing signal at node 222 and the inverse timing signal at node 224 are applied to two input terminals of two separate quad-input AND gates 312. The modulator signal at node 296 is coupled through a shaping network 314 to input terminals of the two AND gates 312. The shaping network consists of series resistors 315 and 316 in parallel with a diode 318. The common connection between the resistors 315 and 316 is coupled to common through a capacitor 320. The output terminals of the two AND gates 312 are coupled through separate inverters 322 and two stages 324 and 326 of amplification to nodes 150 and 204. Networks 328, 330, and 332 provide biasing for the transistors of the amplification stages 324 and 326.

The resultant signals at nodes 150 and 204 are supplied to the modulating transistors 86 and 82 through nodes 150 and 204, respectively. As shown in FIG. 10, the signal at node 150 is denoted the channel A control signal, while the signal at node 204 is denoted the channel B control signal. The channel A control signal is the logical AND of the modulator signal and the timing signal, while the channel B control signal is the logical AND of the modulator signal and the inverse timing signal. Thus, the timing signals determine the alternate phase relationship of the control signals, while the modulator signal determines the width of the pulses. The waveform of the power signal is defined by the control signals. The power transistor pair 58–64 switches on for each positive pulse of the channel A control signal to drive the transformer 18 in one direction. At the falling edge of the channel A control signal pulse, the transistor pair 58–64 switches off and the voltage of the power signal decays to a floating neutral. At the next rising edge of the channel B control signal, the other power transistor pair 60–62 switches on to drive the transformer 18 in the opposite direction. At the falling edge of the channel B control signal pulse, the transistor pair 60–62 switches off and the voltage of the power signal decays back to the floating neutral. The amount of time that the transistor pairs are on is determined by the width of the control signal pulses, which are in turn determined by the width of the modulator signal pulses.

In addition to the timing and modulator signals, the channel A and B control signals reflect two additional factors that influence the on time of the power transistors of the bridge inverter. One such factor is the desire to ramp up gradually the application of power when the generator is first powered up. For this purpose, the soft start circuit 30 generates a soft start signal that is also logically combined with the timing and modulator signals to form the channel A and B control signals. As shown in FIG. 7, the soft start circuit 30 includes two NPN transistors 340 and 342, a capacitor 344, a diode 346, a bias network 348 for the transistors, and an output node 350 where the soft start control signal is formed. The transistor 340 has its base coupled to common through a resistor 352 and coupled to the positive DC voltage at node 56 through a zener diode 354 and resistor 356. The emitters of both transistors 340 and 342 are connected to common. The collector of transistor 340 is connected to the base of transistor 342 and is coupled to node 56 through resistor 358. The collector of transistor 342 is coupled through a resistor 360 to node 56, is coupled through diode 346 to the control terminal of the timer 282, is coupled through capacitor 344 to common, and is connected to the node 350. The soft start control signal is supplied through node 350 to input terminals of the two AND gates 312, where it is logically combined with the timing and modulator signals.

When the generator is first powered up, the voltage at node 56 is at common potential. As the voltage at node 56 starts rising, transistor 340 is switched off due to its connection to common through resistor 352, and transistor 342 is switched on due to its connection to node 56 through resistor 358. With transistor 342 on, the capacitor 344 remains discharged and the soft start control signal at node 350 is at common potential, which causes the channel A and B control signals to be at the logic low voltage, which in turn causes the power transistors of the bridge inverter to remain switched off.

At some intermediate voltage, the breakdown voltage of the zener diode 354 is exceeded and transistor 340 switches on, causing transistor 342 to switch off. The capacitor 344 can now begin charging through the resistor 360. During this time, the voltage applied to the control terminal of the timer 282 is pulled down through diode 346 to a voltage near the voltage on the capacitor 344. Recall that the voltage applied to the control terminal of the timer 282 controls the pulse width of the modulating signal. As the capacitor 344 charges, the pulse width of the modulating signal gradually increases, thus providing a gradual application of power to the transformer 18 and ultrasonic transducer 20. Waveforms of the soft start control signal, the modulator signal, and the resultant power signal during this powerup phase are shown in FIG. 10.

Another factor that influences the on-time of the power transistors of the bridge inverter is the action of the duty cycle controller 32, which provides a degassing modulation. The duty cycle controller 32 generates a duty cycle control signal at node 370, which signal is supplied to input terminals of the AND gates 312 for logically combining with the timing, modulation, and soft start control signals. The duty cycle control signal defines how long during each cycle of the power supply (120 Hz in the illustrated preferred embodiment) the power signal is generated. As shown in FIG. 9, the duty cycle controller 32 includes a 555 type timer 372 having its power input terminal connected to node 56, its ground terminal connected to common, its trigger and reset terminals coupled to common through parallel connected resistor 374 and capacitor 376 and coupled to node 46 through series connected zener diode 378 and resistor 380, its control terminal coupled to common through capacitor 382, and its threshold and discharge terminals coupled to common through a timing capacitor 384 and coupled to node 56 through series connected resistors 386 and 388. In addition, an NPN transistor 390 has its base connected to common, its emitter coupled to the negative voltage portion of the DC power supply 52 through resistor 392 and node 394 and to node 46 through resistor 396, and its collector connected to node 46. The transistor 390 provides a bypass circuit for the voltage applied to node 46. A clamping diode 398 is inserted between node 56 and the common connection between zener diode 378 and resistor 380 and a decoupling capacitor 400 is coupled between node 56 and common.

The timing sequence begins when the rectified power at node 46 sets up a voltage on the zener diode 378 that exceeds its threshold, which sends a high voltage to the trigger and reset terminals of the timer 372. The timer then begins to charge the timing capacitor 384 with current drawn through resistors 386 and 388. The charging rate of the capacitor 384 is adjusted by changing the resistance of the adjustable resistor 388. During this time, the output signal of the timer, which is the duty cycle control signal, is at its logic high voltage. When the timer times out, the output signal of the timer 372 goes to its logic low voltage and remains low until the next power supply cycle. As shown in FIG. 10, while the duty cycle control signal is high, the control signals are generated, which in turn cause the power transistors to generate the power signal. When the duty cycle control signal fall to low, however, the control signals also drop to low and stay there during the remainder of the power supply cycle. The utility of such a dwell time is that degassing can occur during each power supply cycle, with the duration of the dwell time adjustable by the operator.

By separating the control functions from the power generation functions, the generator 10 of the present invention provides a regulated and stable power signal for driving the ultrasonic transducer 20. Short circuit protection is provided by the power controller 28 and modulator 26 by modulating the power signal when the current exceeds a desired amount. Open circuit protection is provided by separation of the bridge driver circuitry from that of the power control circuitry.

From the above description, it will be apparent that the invention disclosed herein provides a novel and advantageous regulated ultrasonic generator operable for supplying a driving signal to an ultrasonic transducer. The foregoing discussion discloses and describes merely exemplary methods and embodiments of the present invention. As will be understood by those familiar with the art, the invention may be embodied in other specific forms without departing from the spirit or essential characteristics thereof. For example, the generator can be used for driving ultrasonic devices other than transducers used in ultrasonic cleaning. Accordingly, the disclosure of the present invention is intended to be illustrative, but not limiting, of the scope of the invention, which is set forth in the following claims.

We claim:

1. An apparatus for generating a driving signal for powering an ultrasonic transducer, said apparatus comprising:

a power supply;

bridge inverter means powered by said power supply for generating a power signal having two alternating components of opposite potential, wherein said bridge inverter means includes four power transistors configured in two pairs thereof, wherein each pair of power transistors generates one component of said power signal;

timing means for generating a timing signal equal in frequency to the desired frequency of said power signal;

bridge driving means responsive to said timing signal for periodically generating base drive signals that when supplied to the bases of said power transistors cause said power transistors to switch on, wherein said bridge driving means alternately generates said base drive signals at the desired frequency for switching on alternate pairs of said power transistors;

bridge modulating means coupled between said bridge driving means and said bridge inverter means for selectively connecting said base drive signals to and disconnecting said base drive signals form the bases of said power transistors, said bridge modulating means including four modulating transistors each coupled between said bridge driving means and a base terminal of one of said power transistors and operable for supplying a base drive signal to its coupled power transistor, said bridge modulating means including means responsive to the power of said power signal for regulating the amount of time during each cycle of said power signal that said power transistors are on by switching on and off said modulating transistors; and means for supplying said power signal to the ultrasonic transducer.

2. An apparatus as recited in claim 1 wherein said timing means includes a first timer running at a frequency equal to twice the desired frequency, and includes a D-type flip-flop that receives the output signal of said first timer as a clock input signal thereto, and wherein said flip-flop generates said timing signal at the desired frequency and also generates an inverse timing signal equal to the logical inverse of said timing signal.

3. An apparatus as recited in claim 2 wherein said first timer includes means for adjusting the frequency of operation of said first timer so as to adjust the frequency of said timing signal.

4. An apparatus as recited in claim 1 wherein said bridge driving means includes a capacitor, a bridge driving transformer, and first and second bridge driving transistors, wherein said capacitor is continuously charged by said power supply, wherein said first and second bridge driving transistors and circuitry associated therewith in response to said timing signal alternately connect a first terminal of the primary windings of said bridge driving transformer to opposite terminals of said capacitor, wherein said bridge driving means further includes means for coupling a second terminal of said primary windings of said bridge driving transformer to a potential intermediate to the potentials alternately applied to said first terminal of said primary windings through said bridge driving transistors, and wherein said base drive signals are generated by secondary windings of said bridge driving transformer.

5. An apparatus as recited in claim 4 wherein said bridge driving transformer includes four secondary windings, each generating a base drive signal for connection to an individual power transistor of said bridge inverter means.

6. An apparatus as recited in claim 5 wherein all of said power transistors are bipolar transistors of like polarity, wherein the two base drive signals generated to drive one pair of power transistors are the opposite polarity as the other two base drive signals generated to drive the other pair of power transistors, and wherein the polarities of said base drive signals alternate according to the frequency of said timing signal.

7. An apparatus as recited in claim 4 wherein said bridge driving transistors are coupled in a complementary manner such that each bridge driving transistor is switched off when the other bridge driving transistor is switched on.

8. An apparatus as recited in claim 7 wherein said timing signal is coupled to the base of one of said bridge driving transistors for switching said bridge driving transistors o and off.

9. An apparatus as recited in claim 1 wherein said bridge modulating means includes four modulating transistors each connected in series between the base of a corresponding one of said power transistors and said bridge driving means, wherein each of said modulating transistors is operable for selectively connecting a corresponding base drive signal to and disconnecting the base drive signal from the base of said corresponding power transistor, and wherein said bridge modulating means also includes modulating transistor switching means for switching said modulating transistors on and off.

10. An apparatus as recited in claim 9 wherein said four modulating transistors are grouped into two pairs thereof, with each pair of modulating transistors being coupled to a corresponding one of said pairs of power transistors.

11. An apparatus as recited in claim 10 wherein said bridge modulating means further includes coupling means for coupling together the control terminals of each pair of modulating transistors, and wherein a controlled transistor of each pair of modulating transistors is directly switched by said modulating transistor switching means and a follower transistor of said pair of modulating transistors is indirectly switched through said coupling means.

12. An apparatus as recited in claim 11 wherein said coupling means includes two coupling transformers with each of said coupling transformers coupling together the control terminals of a pair of modulating transistors so that a control signal applied to the control terminal of a controlled transistor is coupled through said coupling transformer and also applied to the control terminal of the associated follower transistor to switch on or off both transistors of said pair of modulating transistors.

13. An apparatus as recited in claim 10 wherein said modulating transistor switching means includes logic means for combining said timing signal with a modulator signal to generate modulating transistor control signals that control the switching of said modulating transistors, wherein said modulator signal defines the amount of time during each cycle of said power signal that said power transistors are to be switched on in order to obtain a desired output power from said power signal.

14. An apparatus as recited in claim 13 wherein each of said modulating transistor control signals controls the switching of one of said pairs of modulating transistors, and wherein said logic means includes two channels of logic circuitry each channel operable for logically combining said timing signal with said modulator signal to generate one of said modulating transistor control signals.

15. An apparatus as recited in claim 14 wherein one of said channels of logic circuitry includes a first AND gate that logically combines said timing signal and said modulator signal to generate a first modulating transistor control signal, and wherein the other one of said channels of logic circuitry includes a second AND gate that logically combines said modulator signal with the inverse of said timing signal to generate a second modulating transistor control signal.

16. An apparatus as recited in claim 13 wherein said bridge modulating means further includes current sensing means for sensing the current of said power signal, includes current reference means for indicating a desired current of said power signal, includes comparison means for generating a current error signal indicative of the relative difference between the sensed current of said power signal and the desired current thereof, and includes pulse width modulation means responsive to said current error signal for generating said modulator signal.

17. An apparatus as recited in claim 16 wherein said current sensing means includes a current sensing resistor through which said power signal flows, wherein the voltage drop across said current sensing resistor indicates the current of said power signal.

18. An apparatus as recited in claim 17 wherein said current reference means includes a voltage divider coupled between one side of said current sensing resistor and a reference voltage, wherein said comparison means includes a voltage comparator coupled at a first input terminal thereof to an intermediate voltage tap on said voltage divider and coupled at a second input terminal thereof to the other side of said current sensing resistor, and wherein said voltage comparator generates said current error signal according to the voltage difference between the signals applied to the input terminals of said voltage comparator.

19. An apparatus as recited in claim 18 wherein the voltage difference between the signals applied to the input terminals of said voltage comparator is zero when the desired current is flowing across said current sensing resistor.

20. An apparatus as recited in claim 16 wherein said pulse width modulation means includes a second timer triggered at a rate determined by said timing signal, wherein a modulation input terminal of said second timer receives said current error signal and an output terminal of said second timer generates said modulator signal, wherein the pulse width of said modulator signal is determined by the magnitude of said current error signal.

21. An apparatus as recited in claim 16 further comprising soft-start means for gradually increasing the pulse width of said modulator signal during an initial power-up of said apparatus.

22. An apparatus as recited in claim 21 wherein said soft-start means includes a soft-start capacitor that is initially discharged and which gradually charges during the initial power-up of said apparatus, and wherein the voltage of said current error signal supplied to said pulse width modulation means is limited by the charge on said soft-start capacitor during the initial power-up of said apparatus.

23. An apparatus as recited in claim 21 wherein said logic means is responsive to a cut-off signal for generating said modulating transistor control signals for switching off said modulating transistors, and wherein said soft-start means includes means for generating said cut-off signal at the beginning of the initial power-up of said apparatus.

24. An apparatus as recited in claim 13 wherein said logic means is responsive to a cut-off signal for generating said modulating transistor control signals for switching off said modulating transistors, and wherein said apparatus further comprises a duty cycle controller for periodically generating said cut-off signal to control the duty cycle of said apparatus.

25. An apparatus as recited in claim 24 wherein said power supply supplies cyclic power to said bridge inverter means at a frequency less than the desired frequency of said power signal, and wherein said duty cycle controller includes a duty cycle timer that begins timing at the start of each power supply cycle and generates said cut-off signal after a selectable time after the start of the power supply cycle but before the end of the power supply cycle.

26. An apparatus as recited in claim 1 wherein said means for supplying said power signal to the ultrasonic transducer includes an output power transformer coupled to said bridge inverter means for converting said power signal into the driving signal for transmission to the ultrasonic transducer.

27. An apparatus as recited in claim 26 wherein said output power transformer has some inductance that acts to round off the sharp corners of said power signal so that the waveshape of the driving signal is similar to a sine wave.

28. An apparatus for generating a driving signal for powering an ultrasonic transducer, said apparatus comprising:

a power supply;

bridge inverter means powered by said power supply for generating a power signal having two alternating components of opposite potential, wherein said bridge inverter means includes four power transistors configured in two pairs thereof, wherein each pair of power transistors generates one component of said power signal;

timing means for generating a timing signal equal in frequency to the desired frequency of said power signal;

bridge driving means responsive to said timing signal for periodically generating base drive signals that when supplied to the bases of said power transistors cause said power transistors to switch on, wherein said bridge driving means alternately generates said base drive signals at the desired frequency for switching on alternate pairs of said power transistors, wherein said bridge driving means includes a bridge driving transformer and means for supplying an alternating current to said bridge driving transformer, wherein said alternating current is equal in frequency to said timing signal, and wherein said base drive signals are generated by secondary windings of said bridge driving transformer;

bridge modulating means coupled between said bridge driving means and said bridge inverter means for selectively connecting said base drive signals to and disconnecting said base drive signals from the bases of said power transistors, wherein said bridge modulating means includes four modulating transistors and means for switching said modulating transistors on and off, wherein each of said modulating transistors is connected in series between the base of a corresponding one of said power transistors and one of said secondary windings of said bridge driving transformer, wherein said means for switching said modulating transistors includes logic means for combining said timing signal with a modulator signal to control the switching of said modulating transistors, wherein said modulator signal defines the amount of time during each cycle of said power signal that said power transistors are to be switched on in order to obtain a desired current of said power signal, wherein said bridge modulating means further includes means for generating said modulator signal including current sensing means for sensing the current of said power signal, comparison means for generating a current error signal indicative of the relative difference between the sensed current of said power signal and the desired current thereof, and pulse width modulation means responsive to said current error signal for generating said modulator signal; and an output power transformer coupled to said bridge inverter means for converting said power signal into the driving signal for transmission to the ultrasonic transducer.

* * * * *